US006354941B2

(12) United States Patent
Miller et al.

(10) Patent No.: US 6,354,941 B2
(45) Date of Patent: Mar. 12, 2002

(54) ELECTRONIC SYSTEM FOR A GAME OF CHANCE

(75) Inventors: Bradley K. Miller, Tampa; Thomas V. Saliga, Odessa, both of FL (US)

(73) Assignee: 516 Holdings, Tampa, FL (US)

( * ) Notice: Subject to any disclaimer, the term of this patent is extended or adjusted under 35 U.S.C. 154(b) by 0 days.

(21) Appl. No.: 09/433,503

(22) Filed: Nov. 3, 1999

(51) Int. Cl.[7] ..... A63F 3/06
(52) U.S. Cl. ..... 463/19; 463/42; 273/269
(58) Field of Search ..... 273/269; 463/19, 463/42, 138.1

(56) References Cited

U.S. PATENT DOCUMENTS

| | | | | |
|---|---|---|---|---|
| RE32,480 | E | * | 8/1987 | Bolan |
| 5,007,649 | A | | 4/1991 | Richardson |
| 5,043,887 | A | | 8/1991 | Richardson |
| 5,054,787 | A | | 10/1991 | Richardson |
| 5,072,381 | A | * | 12/1991 | Richardson et al. |
| 5,096,202 | A | * | 3/1992 | Hesland |
| 5,178,395 | A | * | 1/1993 | Lovell |
| 5,230,514 | A | | 7/1993 | Frain |
| 5,476,259 | A | * | 12/1995 | Weingardt |
| 5,478,084 | A | | 12/1995 | Itkis |
| 5,569,083 | A | * | 10/1996 | Fioretti |
| 5,588,654 | A | * | 12/1996 | Voigt |
| 5,755,619 | A | | 5/1998 | Matsumoto et al. |
| 5,930,026 | A | | 7/1999 | Jacobson et al. |
| 5,967,895 | A | * | 10/1999 | Kellen |

* cited by examiner

*Primary Examiner*—Benjamin H. Layno
*Assistant Examiner*—Vishu Mendiratta
(74) *Attorney, Agent, or Firm*—David Kiewit

(57) ABSTRACT

Electronic equipment is provided for playing a bingo-like game in a fashion closely simulative of the well known game of bingo played with paper cards. The three main functional components are: a) a central computer that is used both to determine which sets of faces are downloaded into players' game boards and to reconcile cash received by a salesperson with the number of downloaded games authorized to be played; b) players' game boards, each of which is adapted to receive enabling messages from a sales unit, to display enabled sets of playable indicia simulative of a bingo card and to modify that display responsive to a player's input; and c) the sales unit, which is adapted both to send an enabling message to a player's game board responsive to a manual input from a salesperson, and to record each such enabling transaction for later upload to the central computer. Another feature of the system is a switching arrangement for controlling a LCD display in a manner simulative of the use of a conventional ink dauber in marking a paper bingo card. This may be done by using a permanent magnet disposed on a simulative dauber that cooperates with a Hall-effect, or other, magnetic field sensor disposed behind an LCD display cell.

11 Claims, 6 Drawing Sheets

ELECTRONIC SYSTEM FOR A GAME OF CHANCE

CROSS REFERENCE TO RELATED APPLICATIONS

Not Applicable

BACKGROUND OF THE INVENTION

1. Field of the Invention

The invention pertains generally to electronic gaming systems and particularly to systems simulating the well-known game of bingo.

2. Background Information

The well-known game of bingo commonly involves a group of players and a caller, who calls or announces randomly selected indicia, which commonly comprise integral numbers within a predetermined range. Any called number may match one of the numbers on a patterned array, commonly called a "face", or "permutation" or "perm", that has been sold to a player. The most popular face is a 5×5 array of integers from which the central integer is removed to provide a "free" space. Each players of a conventional bingo game plays one or more such arrays during a given game by marking off called numbers (e.g., by means of a ink dauber that permanently obliterates the called number) that appear on any of those faces. Play continues until one of the players marks off a pre-announced winning pattern of numbers (e.g., five marked indicia, including the free space, in a straight line) and calls "bingo". The caller, or other administrative employee of the bingo operator, then checks to see that the player's allegedly winning permutation is a correct winning permutation, and authorizes a payout if it is. It will be recognized by those skilled in the gaming arts that the actual game of bingo is only one of a number of bingo-like games of chance wherein a player views a proximally displayed patterned array of indicia (e.g., a bingo card) that comprises a subset of all such indicia, monitors a master sequence of indicia from the set of all possible indicia (e.g., the sequence of called numbers) supplied by an operator of the game, marks those indicia from the master sequence that appear on his or her array (e.g., by daubing a printed integer with ink) and receives a payout if a correctly marked subset of the randomly generated sequence corresponds to a characteristic winning pattern of the indicia disposed on his or her local display (e.g., having all four corners covered on a regular bingo card). Generally speaking, in such bingo-like games the operator receives payment for each proximally displayable array of indicia from each of a plurality of players prior to generating the master sequence of indicia.

Many bingo players choose to play more than one face simultaneously, an arrangement commonly called "N-on play", where N is the number of faces selected. Responsive to this practice, some bingo operators sell cards having multiple faces printed thereon, with up to an 18-on card being known. It is generally thought that even a skilled player can not simultaneously follow the course of the game on more than six faces. Hence, playing more than 6-on may inherently require the player to view sets of faces sequentially, which limits the speed at which the player can respond to calls.

Bingo-like games are commonly played in sessions comprising a sequence of games, each of which is played on cards separately designated (e.g., color-coded) for a particular game in the session. To facilitate multi-game play, the bingo game operator commonly provides one or more floor-walking salespersons who sell cards to the players before a bingo session begins and between the games that make up that session.

There have been many attempts in the prior art to provide an electronic simulation of a bingo session, but none have proven popular. These prior art attempts appear to have failed by using design features that were technically convenient but that did not adequately reproduce or simulate the experience of playing a conventional bingo game. Notable among U.S. patents in this area are:

Richardson, in U.S. Pat. Nos. 5,007,649; 5,043,887; 5,054,787; and 5,072,381 teaches an electronic bingo system in which a plurality of arrays of indicia, each corresponding to a separately displayable face, are downloaded from a central computer into a memory portion of a player's electronic game board. A floor-walker's validation terminal is used to validate a winning combination by means including receiving a unique game-specific code (which may conveniently be a serialized number known as a "permutation number" associated with a particular algorithm for generating the set of all permutations of allowable indicia) from the allegedly winning game board. Richardson's game board comprises a card display and a keypad. The use of the keypad to enter called numbers is not simulative of the physical marking of paper cards. Moreover, Richardson's game board displays only a single face and thereby fails to facilitate N-on play.

Itkis, in U.S. Pat. No. 5,478,084, teaches a mechanical bingo machine that displays multiple playable faces at one time (e.g., a 6-on card) and that uses a permanent magnet to move suspended ferromagnetic particles from a hidden side of a display board to a visible side in order to make a white-to-black transition, simulative of an ink dauber being used, to mark called numbers.

Frain, in U.S. Pat. No. 5,230,514, teaches an electronic game board comprising 2-on to 18-on card displays and a plurality of player input means, including means to select a special game. Frain provides no way of changing the display on any one of the boards. A player who wants a different set of numbers is required to turn her board in for another one.

Matsumoto et al., in U.S. Pat. No. 5,755,619, show a casino bingo apparatus in which each player uses a touch-screen terminal hard-wired to a central unit. The central unit keeps score and uses conventional bingo balls to generate called numbers. The required wiring makes installation of Matsumoto's apparatus expensive and essentially requires a dedicated facility.

BRIEF SUMMARY OF THE INVENTION

A preferred system of the invention provides electronic equipment for playing a bingo-like game in a fashion closely simulative of the well known game of bingo played with paper cards. This preferred system comprises three main functional components including: a) a central computer that is used both to determine which sets of face-simulative numbers or other indicia are downloaded into players' game boards and to reconcile cash received by a salesperson with the number of downloaded games authorized to be played; b) a plurality of players' game boards, each of which is adapted to receive enabling messages from a sales unit, to display enabled sets of playable indicia simulative of a bingo card and to modify that display responsive to a player's input; and c) the sales unit, which is adapted both to send an enabling message to a player's game board responsive to a manual input from a salesperson, and to record each such enabling transaction for later upload to the central computer.

It will be recognized by those skilled in the computer arts that a small system of the invention could comprise only two physically distinct types of components by using a plurality of game boards and a single operator's computer that combined the functions of the base computer and the sales unit.

One of the features of a preferred embodiment of the invention is a player's game board comprising an electronically controlled display and a player input means. The display is preferably a liquid crystal display (LCD) panel, adapted to display a plurality of arrays of indicia simulating a printed card. A particular preferred embodiment simulates a 6-on card display. In a further refinement of this embodiment, the apparatus comprises a 6-on display of playable faces, a reduced size and resolution display of at least a second 6-on set, as well as means usable by the player to select which of the 6-on sets is displayed at the higher resolution for active play.

Another of the features of a preferred embodiment of the invention is a switching arrangement for controlling a LCD display in a manner simulative of the use of a conventional ink dauber in marking a paper bingo card. In one preferred embodiment the switching arrangement comprises a permanent magnet disposed on a simulative dauber that cooperates with a Hall-effect, or other, magnetic field sensor disposed behind a display cell in which a selected one of the playable indicia is displayed. Bringing the dauber proximate to the display cell causes the sensor to provide an output to a display controller which replaces the previously displayed indicium with a modified one until the display is reset. This simulates the permanent marking of a printed bingo indicium with an ink dauber. It will be understood that a system of the invention may be configured to use any one of many other sensing arrangements for sensing the proximate presence of a marking device.

An additional feature of a preferred embodiment of the invention that is particularly compatible with the use of a proximity dauber is the use, in bingo game, of a sealed, liquid-tight housing preferably having no metallic electrical connections extending through it. Prior art electronic game boards that have not been sealed have sometimes failed in service when a player accidentally spilled a beverage onto the game board during the course of play.

In addition to the use of a sealed housing, several other features of preferred embodiments of the invention are also directed at ensuring that a game board does not fail during use. In service failure of prior art electronic game board has sometimes led to excited and hostile reactions from players who felt they had been cheated out of a victory. Principal among these other features is the provision of a redundant power supply arrangement in which electric power is normally supplied to the game board by a main, rechargeable, battery, but in which a back-up battery is automatically switched in to operate the game board whenever the main battery is discharged or otherwise becomes inoperative.

Yet another of the features of a preferred embodiment of the invention is the provision of a color-coded or pattern-coded game-indicating indicium or flag on a player's game board. This flag is simulative of the use of different card colors or patterns printed on a paper bingo card and used to denote the game within a multi-game session in which that particular paper card is to be used.

Although it is believed that the foregoing recital of features and advantages may be of use to one who is skilled in the art and who wishes to learn how to practice the invention, it will be recognized that the foregoing recital is not intended to list all of the features and advantages. Moreover, it may be noted that different embodiments of the invention may provide various combinations of the hereinbefore recited features and advantages of the invention, and that less than all of the recited features and advantages may be provided by some embodiments thereof.

DETAILED DESCRIPTION OF THE INVENTION

Figure 1:
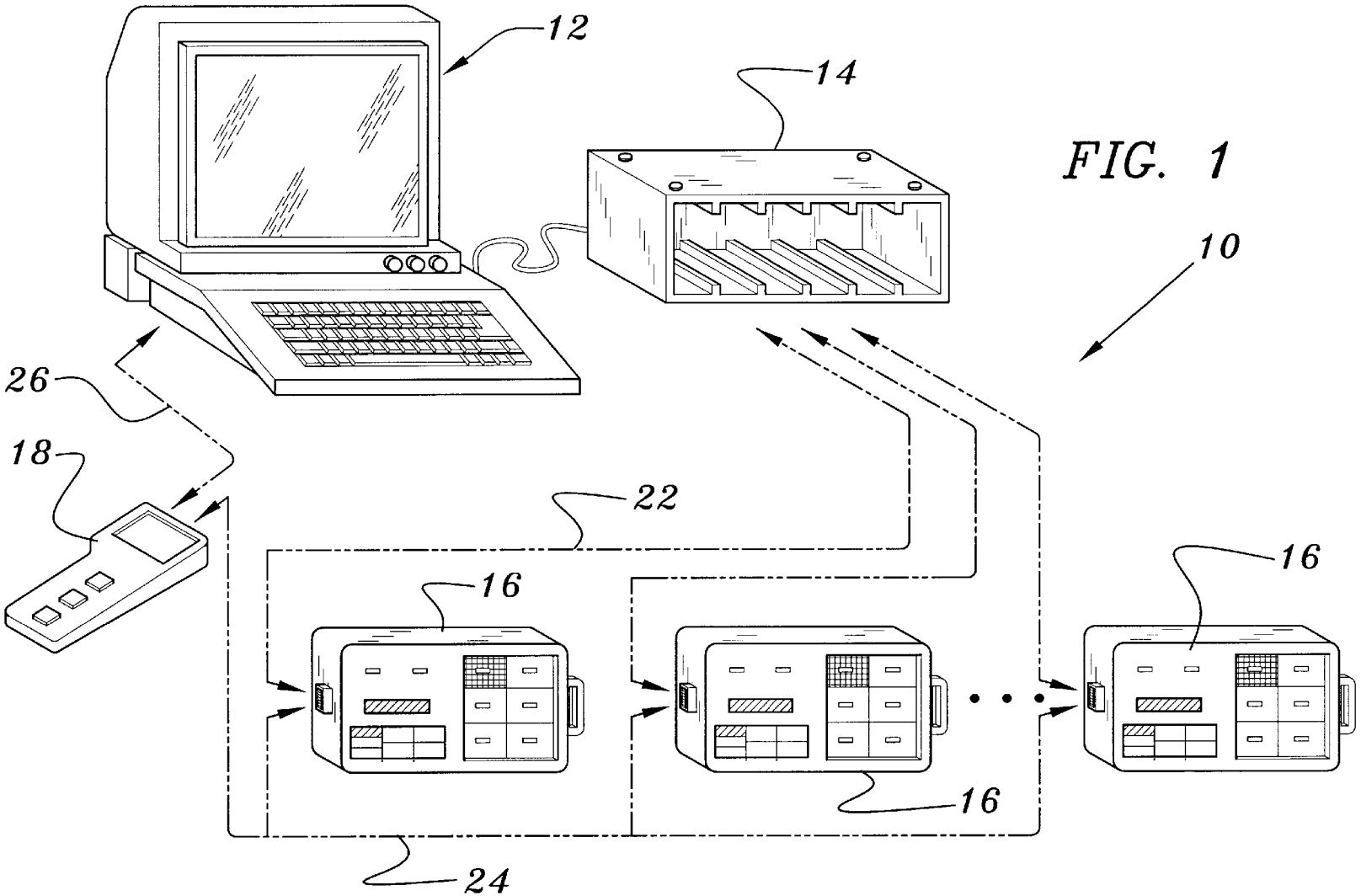
FIG. 1 is an elevational view of a gaming system of the invention.

A preferred system of the invention 10, as depicted in FIG. 1, comprises a base computer 12 that may have associated therewith a docking station 14, a sales unit 18, and a plurality of game boards 16, each having a sealed housing 17. The docking station 14 may comprise means for recharging a battery 20 in each of the game boards 16, as well as means for providing a data communication path 22 between the computer 12 and the game boards 16. The sales unit 18, as will be disclosed in greater detail hereinafter, is configured to communicate both with the game boards 16 (as indicated by the triple-dotted line 24 in FIG. 1) and with the base computer 12 (as indicated by the single-dotted line 26 in FIG. 1).

The preferred system employs a secondary battery 20 in each game board 16 and in the sales terminal. However, it will be understood by those skilled in the art of portable computer-based hardware that there are many other means of supplying electric power to this sort of equipment. Because of the low power consumption and intermittent use of the game boards 16, one could also choose to power them by primary batteries, by photovoltaic cells adapted to receive optical power from ambient illumination at a bingo hall or the like, by inductive coupling with coils (not shown) disposed under a table or other horizontal surface at the playing location, or by any other means known in the art. In a particular preferred embodiment of the game board 16, regulated electric power is available from a power supply circuit comprising selection means for selectively drawing unregulated electric power from either a main battery 20 (which may be a lead-acid or nickel metal hydride or other known rechargeable battery) or from a back-up battery 21 (which may be a primary battery with a slow self-discharge rate, a secondary battery electrically connected to and recharged by a photovoltaic cell 23 or any other known battery suitable for standby service). When the game board 16 is turned on at the beginning of a session, which may be done by bringing the magnetic dauber 60 up to a magnetic reed switch 25 sealed within the housing 17, the power supply circuit 27 normally draws power from the main battery 20 and supplies regulated DC power to various components in the game board 16. If the main battery 20 is inadequately charged or is otherwise not able to supply power, this battery condition is sensed by known selection means in the power supply 27, which then selectively draws power from the backup battery 21 and supplies a signal output to a control means, such as the microprocessor 40 (e.g., over a signal line 28) depicted in the drawing, so that the microprocessor can send a battery problem report to the base computer 12 whenever that game board next communicates with the base computer 12.

Although the base computer 12 is depicted as a conventional desktop computer in FIG. 1, it will be understood that many other configurations (e.g., as a point of sale terminal or electronic cash register) are possible. It will be understood from the disclosure hereinafter provided that additional base computers 12 may be present at a playing location for backup purposes or to deal with periods of high activity. Also, as noted above, a small system of the invention could be configured with a single operator's computer that ran a first stored program to perform the base computer functions before and after a gaming session and that ran a second stored program to perform the sales computer functions during the gaming session. Moreover, it will be understood to those skilled in the data collection and communication arts that a local system of the invention 10 could be configured to communicate with a central computer system (not shown) over the public switched telephone network, or by other suitable means, if the operator of the gaming arrangement employed multiple such systems at various locations.

Figure 2:
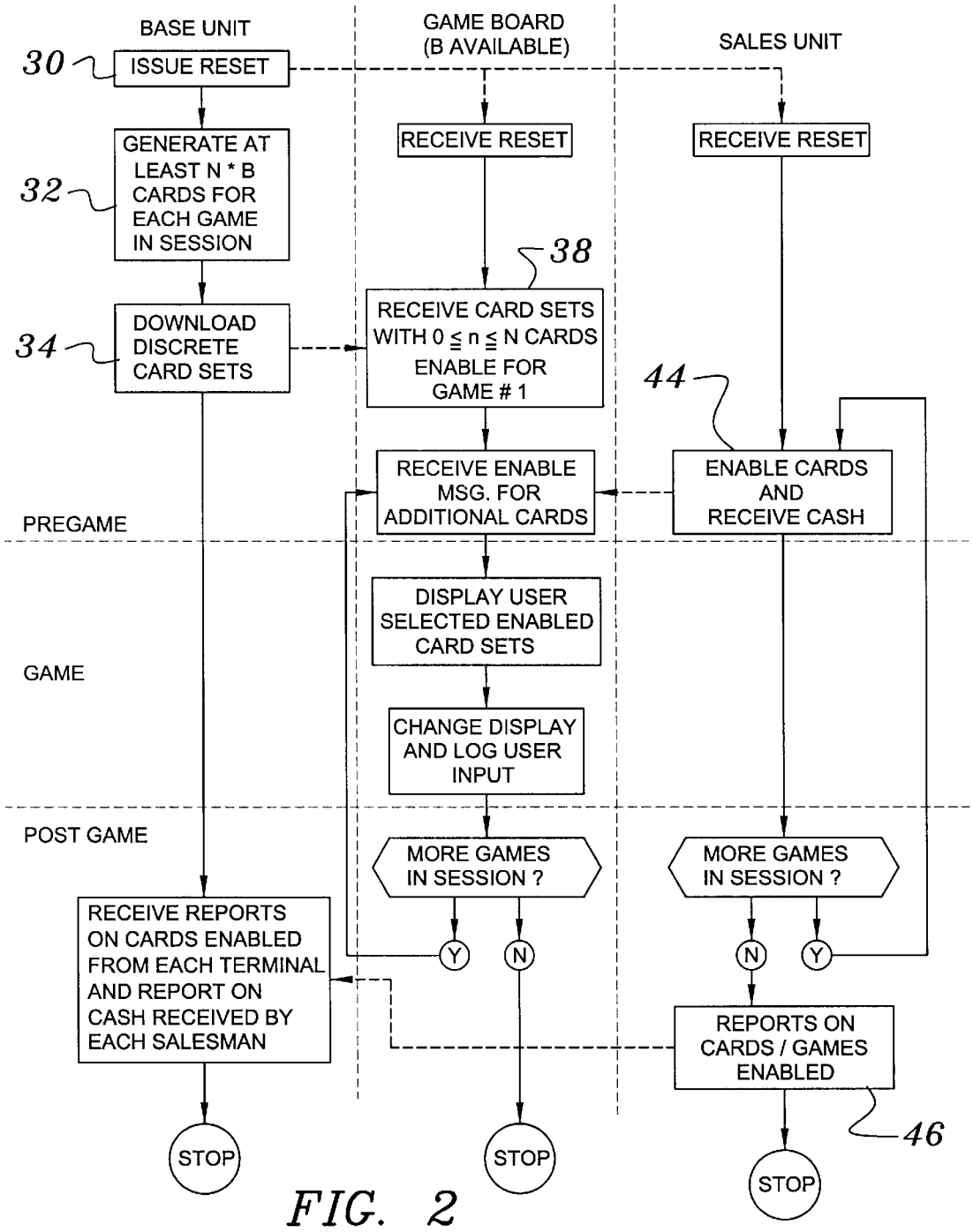
FIG. 2 is a top level system flow chart for the three major components.

Turning now to FIG. 2, one finds a set of three linked flow charts depicting the operation of the base unit 12, game boards 16 and sales unit 18. In an initialization Step 30 the base unit issues a reset message to each of the game boards 16 and sales units 18, and then generates (in Step 32) a plurality of patterns of indicia, each corresponding to a separately playable face or permutation. As depicted in FIG. 2, if a predetermined number, G, of games are to be played in an ensuing session; if each game board has a maximum number, N, of faces that it can display for play during any one of the G games; and if B game boards are available for use, the base computer 12 generates at least G times N times B faces, and preferably downloads (Step 34) a separate respective subset comprising B times N of these faces into each of the B game boards. Once this download operation has been carried out, the base computer 12 may then be idle until after the end of the session, or may be used for other gaming functions, such as random number generation for the calls, cash accounting, and the like. As is well known in the gaming arts, all such satisfactory arrangements must ensure that no two faces used in a given game can have the same patterned array. In one particular arrangement, the base computer 12 generates called numbers and checks, after each call, to see if any of the possible permutations could be displaying a winning configuration. The base computer 12 can display a list of permutation numbers corresponding to possible winning permutations and update that list after each call. Inasmuch as not all permutations are in play in a single game, it is not expected that the game will end when the first possible winner appears on this display. This list can, however, be used to validate a claimed win by checking the permutation number of an allegedly winning face against the list of possible winners.

As hereinbefore noted, the base computer 12 may communicate with a remote host computer. In this case, it will be understood to those skilled in the art that the plurality of patterns could be generated at the remote location and downloaded into the base computer 12 from the host. It is also possible that a host could supply each of a plurality of base computers with a selected set of initialization parameters to be used by an algorithm for locally generating a set of faces. In this manner a system operator could arrange for each of a plurality of sites to dispense sets of faces.

As previously described, each of the game boards 16 receives a downloaded set of faces after initially being reset. This communication is preferably via non-contact means, such as an inductive coupling 33 or LED (not shown) arrangement, that does not involve metallic connections extending through the sealed housing 17 of the game board. The downloaded faces are stored in a read-write memory such as a dynamic RAM 36. Of the N faces assigned to a first scheduled game, some selected number, n, may be automatically enabled (Step 38). That is, the operator of the system 10 may choose to reduce the floor-walking salesperson's initial workload by passing out a game board 16 having n enabled games to each player who pays an entry fee prior to a session. It will be understood to those skilled in the computer arts that a game board 16 preferably comprises a microprocessor 40 operating under control of a stored program that is conventionally stored, along with some game-related parameters, in a ROM 42. Also, as is conventional in the computer arts, a set of data representative of the downloaded permutations or patterned arrays of indicia may be stored in a RAM 36.

The floor-walking salesperson's apparatus, as indicated in FIG. 2, can be controlled by the salesperson to issue an enabling command (Step 44) to a game board when a player pays for an additional face or faces to be played during one of the games of a session. Transaction data are stored in the sales unit 18 until the end of a session, at which time a set of records comprising at least data on the number of games enabled and payments received is communicated (Step 46) to the base unit 12. The minimum essential data flow between the sales unit 18 and game board 16 is thus a) an enabling message that is passed to the game board; b) a counter (which may be implemented in either hardware or software) in the sales unit that is updated to reflected the total number sold since the immediately preceding system reset; and c) the total number of "enables", which is transmitted to the base unit when the salesperson turns in receipts for counting. It will be understood that these sales data can be organized in many ways and may comprise more detailed transactional information, such as the unique identity of the game board that was enabled at any given transaction and the time of the transaction. Moreover, it is expected that the operating program for the sales unit 18 may be modified to allow for payment by means other than cash (e.g., by use of a prepaid debit card).

Although it is clearly possible to use a computer playing the role of base unit to run a random number generation algorithm and thereby generate the calls in a game of bingo, this is not a necessary feature of the invention. In fact, it is expected that a preferred approach to using the system of the invention will be to use it with conventional means of generating called indicia and validating wins. As is well known, the play of a game of bingo continues until a player covers or marks a winning pattern of indicia and calls bingo. At this point, play stops and the player who called bingo submits his or her winning face to a representative of the game operator for validation of the claimed win. In preferred systems of the invention, both the base unit 12 and sales unit 18 comprise computer apparatus that can be programmed for use in validating a claimed win. That is, if a computer apparatus is supplied with the list of called indicia and data representative of the pattern of indicia disposed on a given card (e.g., which could be stored in a database comprising records relating each face's unique identification number to its displayed pattern of indicia), the computer can be used to automatically validate a claimed win by interrogating the claimant's game board as to the permutations currently being played. On the other hand, it is not necessary that either the base unit or the sales unit be involved in the validation activity. Because the preferred system of the invention simulates the game of bingo as played with paper cards, a claimant need only present the card to an operator's representative for the representative's visual inspection.

Figure 3:
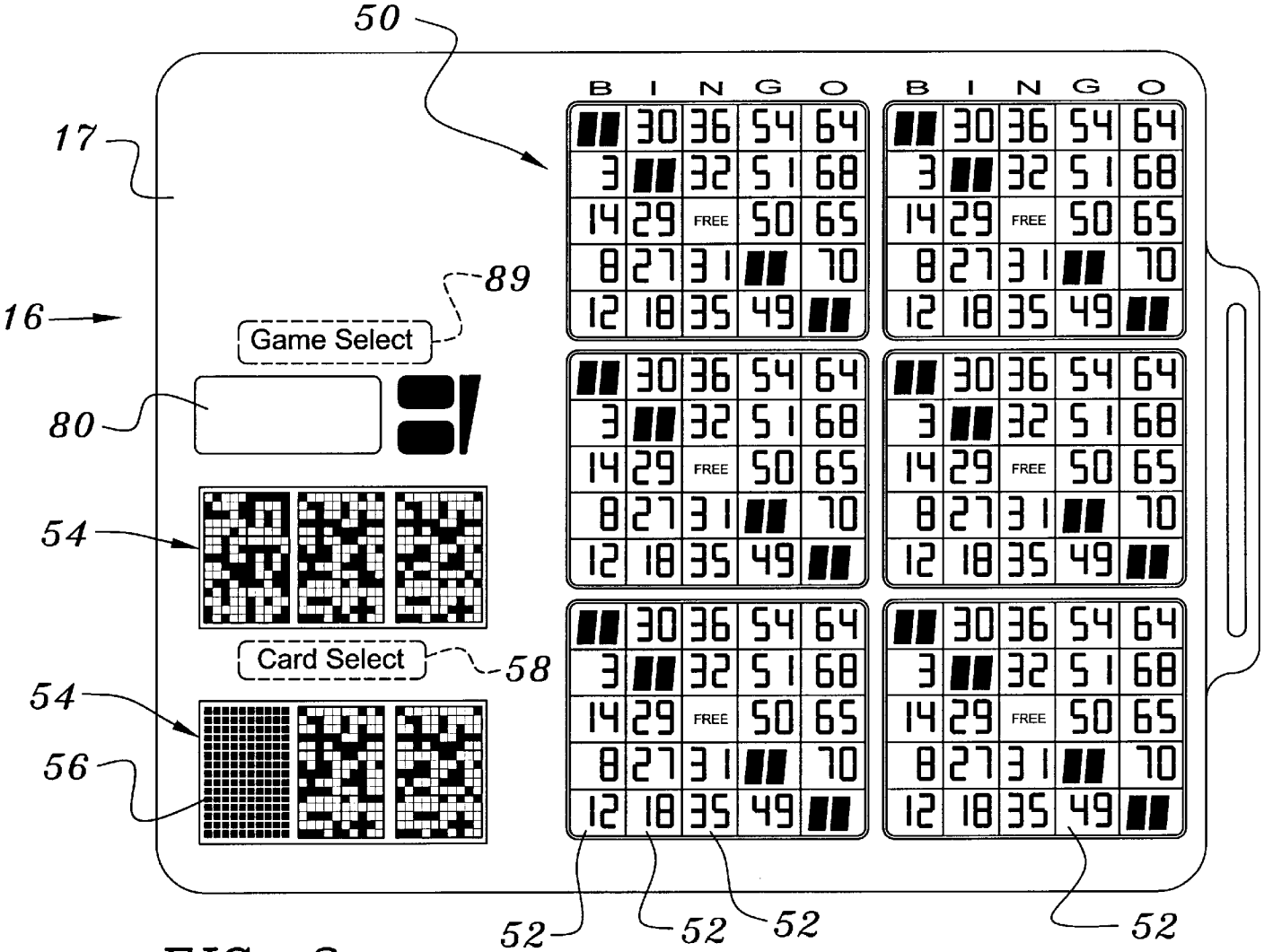
FIG. 3 is an elevational view of an electronic gaming board of the invention.
Figure 4:
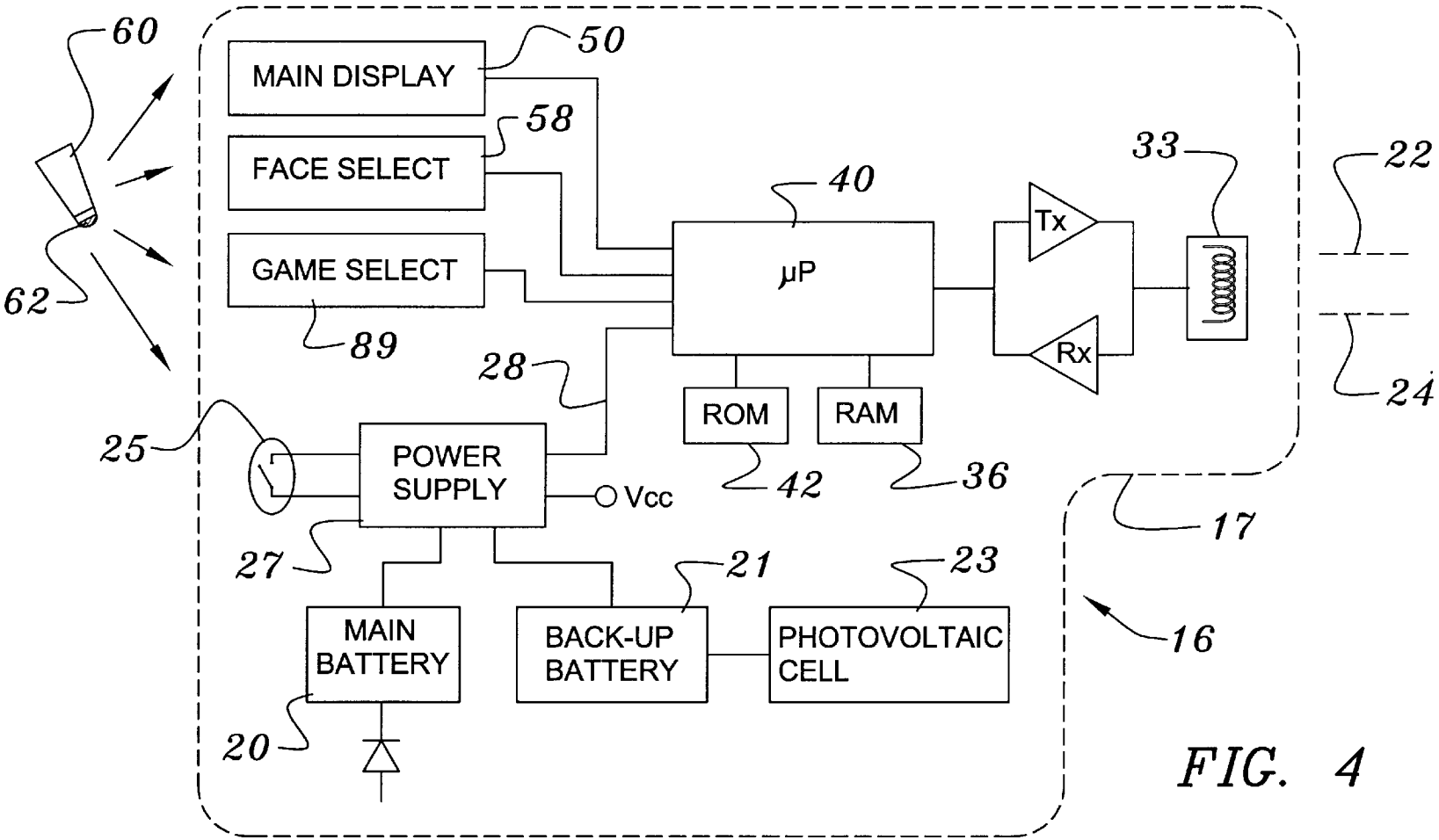
FIG. 4 is a schematic block diagram of the gaming board of FIG. 3
Figure 5:
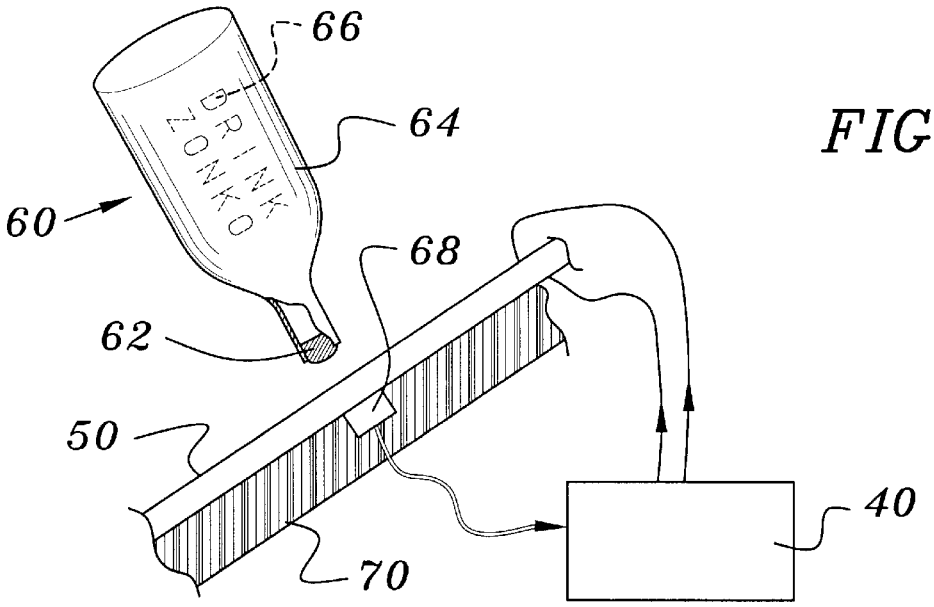
FIG. 5 is a partly cut-away, partly schematic view of a magnetic dauber and a display modified by the dauber.

Turning now to FIG. 3, one finds a depiction of a preferred game board 16, which allows for simultaneous play on a plurality of game faces. In the example of FIG. 3, the game board 16 comprises at least an active display portion 50 adapted to display an N-on array of playable faces. The active display portion 50 has individually addressable and dynamically alterable cells 52, each of which is adapted to display a single playable indicium. In the depicted embodiment a 6-on arrangement is used. In addition to the playable display 50, a game board may comprise a low resolution display 54 showing additional faces, but not providing a player with the capacity to alter any of the cells currently displayed on the low resolution display or display portion. These additional faces may be shown at a sufficiently coarse resolution that not all the details of individual indicia are discernible, but the pattern of marked cells is visible. In a game board of this sort, an "n-on face-select" switching means 58 having an input to a game board control means, such as the microprocessor 40, can be provided (e.g., one using the "dauber" that will be disclosed in greater detail hereinafter) so that a player can select which of a plurality of n-on arrays is to be displayed in the active, high resolution display 50. In the example shown in FIG. 3, the game board 16 provides a player with thirty six playable faces comprising six different 6-on arrays, where the active 6-on array is visibly marked on the low resolution portion of the display, as shown by the shaded region 56.

It will be recognized to those skilled in the art that many variations on the game board layout are possible. One could select more or fewer than six for the number of faces to be played at a time. Because this would effect the overall size of the active display, both the electrical power requirements and cost of manufacture of the board would be impacted by any decision on the size and complexity of the active array. For example, one could eliminate the low resolution displays and obtain a simpler, cheaper game board that would be satisfactory for players who did not want to go beyond 6-on play. Moreover, it should be clear that although FIG. 3 depicts faces having alphanumeric indicia, other sorts of indicia may be used with a bingo-like game and could be accommodated by the use of a dot-matrix display. Additionally, although the disclosure supra describes the active and low-resolution displays as though they were separate physical components, it should be clear to those skilled in the art that the same functional features could be supplied by using separately assignable regions of a single large display (e.g., by providing a windowed representation on a CRT).

The game board 16 is expected to be a stand-alone device that can be used anywhere a bingo card is used. In most cases, this implies that AC electrical power will not be available for the game board, and that the board will operate on batteries and will use a relatively low power consumption display in order to maximize playing time. Initially, it is expected that the preferred display 50 will be a black and white LCD panel. Many alternate display technologies, such as a color LCD, a seven-segment LED, a plasma panel, or a CRT could be used with the system and might well be used with variations thereof that do not rely on battery power.. In particular, an emerging technology providing an "electronic ink" or "e-ink" display, which is described by Jacobsen et al. in U.S. Pat. No. 5,930,026, might someday provide an optimal display requiring power only when the displayed data are being changed. The disclosure of Jacobsen et al. in U.S. Pat. No. 5,930,026 is herein incorporated by reference.

Preferred embodiments of the invention provide a player with a marking means, or "dauber" 60, simulative of the ink dauber that is commonly used when playing bingo with paper cards. In a preferred embodiment, the marking device 60 comprises a permanent magnet 62 (which may be made of a rubber body impregnated with a ferromagnetic material) and a handle 64, which is generally selected to be of the same size and shape as is used with ink daubers, and which may be incidentally imprinted with advertising messages 66 and the like. The choice of a rubberized carrier for the magnet is expected to minimize scratching and other mechanical damage to the display panel with which it is used.

Figure 6:
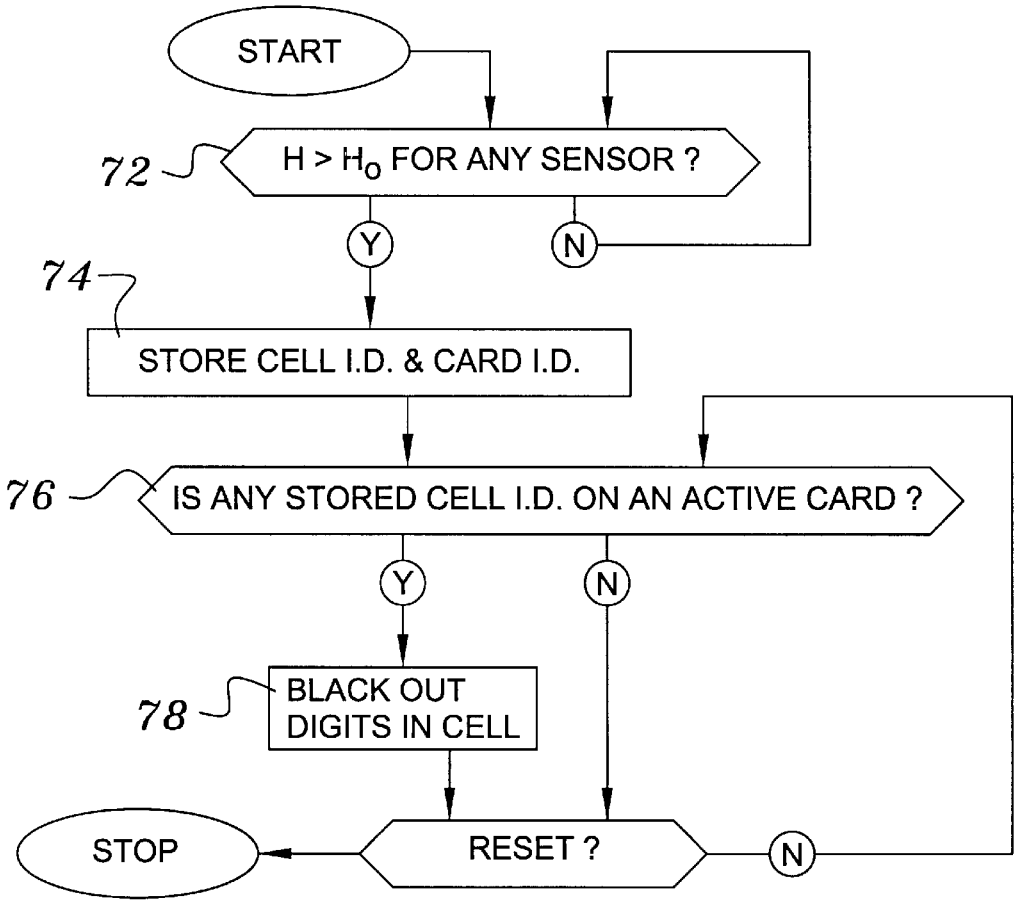
FIG. 6 is a flow chart showing the operation of the magnetic dauber of FIG. 5.
Figure 7:
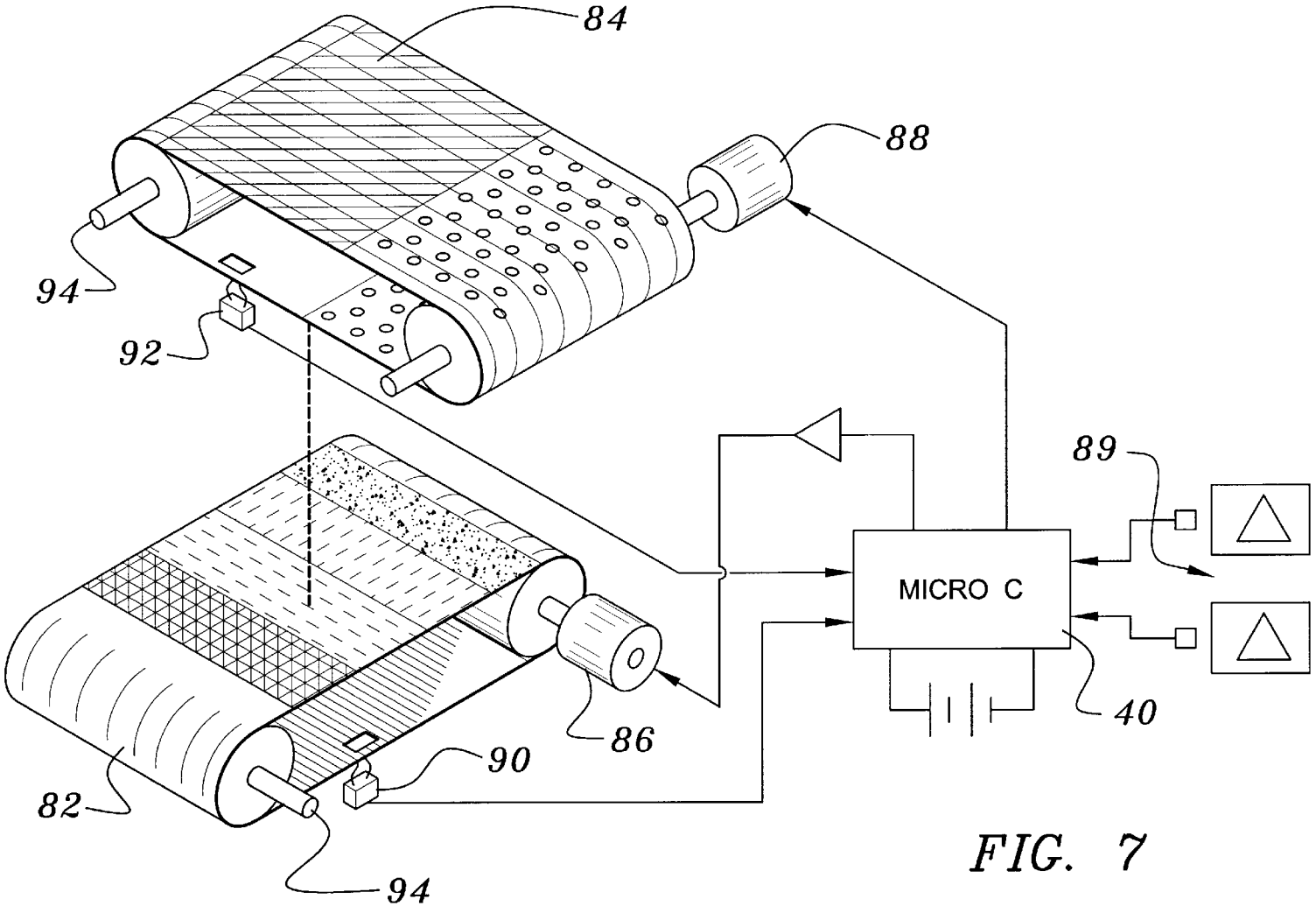
FIG. 7 is a schematic view of a preferred game flag changing mechanism.

In a preferred game board 16, a Hall effect sensor 68 is mounted in a backing plate 70 on which the active display 50 is supported. Thus, when the permanent magnet 62 is brought up to one of the cells 52, the magnetic sensor disposed therebehind provides an output to the microprocessor 40 which controls the display 50 so as to visually alter the appearance of that cell in a suitable manner—e.g., by blacking it out, by changing the background pattern or color of the marked cell, or by replacing the indicium with one having a line drawn through it. In keeping with a desire to simulate the use of ink on paper, the display cell 52 can be maintained with its altered appearance throughout the duration of the game. This may be better understood with reference to the flow chart of FIG. 6, wherein the proximity of a marking device or dauber 60 is detected adjacent a cell 52 (Step 72) and the cell and face identity are stored in memory 36 (Step 74). The microprocessor 40 then checks (Step 76) to see if any of the stored cells is on an active card, and, if it is blacks out (or otherwise visually encodes) the indicium in that cell (Step 78). Thus, even if a marked cell is on a face that is "moved" off the active display, when that face is brought back to the active position the cell in question is still displayed as a marked cell.

In a particular preferred embodiment, the combination of a magnetic dauber 60 and an alterable display can be used in confirming that an alleged win is correctly claimed. In this case a Hall effect sensor is disposed behind the central "free" space on a playable display and the microprocessor is programmed to temporarily blank out the daubed spaces and use a single row of display cells to show that face's permutation number. If this permutation number matches a list of possible winning permutations, then the claimed win is validated.

In a preferred embodiment the Hall sensor is made by Allegro Micro Systems, Inc., and has part number A3240ELH. It will be understood, however, that many other magnetic sensors, not all of which employ the Hall effect, could be used. Moreover, many other proximity sensing approaches could be used to control the display 50 in a manner simulative of marking a paper card with ink. These methods include at least: mechanical or capacitive switches (in which case the "marking means" used by the player could be one of the player's fingers); a passive inductive circuit disposed in a dauber and co-acting with a plurality of tuned circuit sensors disposed behind respective display cells; or a battery-powered optical, infra-red, or RF emitter in the dauber co-acting with a corresponding sensor associated with each display cell. Moreover, although the "daubing" arrangements discussed above are usable with low power LCD displays, if the system of the invention is used with an AC-powered game board, a known touch-screen CRT could be used.

Color coded paper bingo cards are widely used in multi-game sessions. A specific predetermined color is used to indicate which cards may be used in any particular game of the session. The system of the invention provides several means of attaining the same goal of visually marking a card with a characteristic indicium or "flag" so that both the player and the operator know that the card is to be used in a particular game of the session. In some embodiments, a game card 16 of the invention comprises a display window 80 used to indicate the current game. This window 80 may comprise an LCD alphanumeric display used to communicate the game identifying indicium (e.g., by showing "Game 3" or "Green"). Alternately, a patterned or colored indicium may be provided in the window 80 by disposing one or more controllably movable colored or patterned members, such as the endless belts or bands 82, 84, therebehind. These bands 82, 84 are preferably made from a semi-transparent flexible plastic sheet and are driven by respective stepping motors 86, 88 controlled by the microprocessor 40 in the game board responsive to a game select input 89 switch actuated by the proximity of the dauber 60. As is known in the art, the position of each band can be checked by optical, or other, position sensors 90, 92. It will be realized that if only a small number of color or pattern variations are needed, one of the bands 82, 84 can be eliminated to reduce cost. Moreover, one could easily configure a manually operated color changing arrangement in which the player could move a band 82 by manually rotating a roller shaft 94, e.g., by means of a knob attached thereto. In this manually operated version, it is expected that a position sensor 90 would still be employed to allow the microprocessor 40 to determine which color or pattern had been selected so that the correct perms could be displayed.

Although the present invention has been described with respect to several preferred embodiments, many modifications and alterations can be made without departing from the invention. Accordingly, it is intended that all such modifications and alterations be considered as within the spirit and scope of the invention as defined in the attached claims.

What is claimed is:

1. A gaming system for use by an operator and a plurality of players for playing at least one selected bingo-like game in a session comprising a first predetermined number thereof, the system comprising a base computer, a sales computer and a plurality of game boards, wherein:

each of the game boards comprises:

a respective game board computer having respective computer memory operatively associated therewith, each of the game board computers operating under control of a game board program stored in the respective computer memory; and a respective game board display controlled by the respective game board computer;

wherein the base computer operates under control of a base computer program to download data representative of at least the first predetermined number of respective patterned arrays of indicia into the respective computer memory of each of the game board computers, each of the patterned arrays associated with only a respective one of the games in the session thereof, and the sales computer operates under control of a stored program to communicate a respective enabling message associated with the at least one selected game to a selected one of the game board computers responsive to an input from the operator; and wherein the selected game board computer controls the respective game board display to display at least one respective patterned array of indicia associated with the selected one of the games after the respective game board computer receives the enabling message, the respective game board display otherwise controlled to not display the respective patterned array of indicia.

2. The gaming system of claim 1 wherein the base computer operates under control of the base computer program to download a second predetermined number, greater than one, of sets of indicia into the respective game board memory of each of the game board computers for each of the games in the session, and wherein the display of the selected game board is controlled to simultaneously display a third predetermined number, no greater than the second predetermined number, of sets of indicia after the respective game board computer receives the enabling message from the sales computer.

3. A gaming system for use by an operator and a plurality of players for playing a bingo-like game wherein each of the players selects a respective number of faces to play, the system comprising a base computer, a sales computer and a plurality of game boards, wherein:

each of the game boards comprises:

a respective game board computer having respective computer memory operatively associated therewith, each of the game board computers operating under control of a stored game board program, each of the game board computers programmed to store data representative of at least a first predetermined number that is greater than one and that is denoted as N, of playable faces in the respective computer memory; and a respective game board display controlled by the respective game board computer to display up to N playable faces;

wherein the base computer operates under control of a base computer program to download data representative of at least N respective playable faces into the respective computer memory of each of the game board computers; and the sales computer operates responsive to an input from the operator to communicate a respective enabling message corresponding to a number of faces, M, selected to be played by a respective one of the players to the game board computer associated with that player; and wherein the game board display of the selected game board is controlled by the respective game board computer to display the M playable faces only after receiving the enabling message.

4. The gaming system of claim 3 wherein each game board display further comprises:

a respective second display apparatus controlled by the respective game board computer to display a respective additional set of up to N playable faces on a second portion of the respective game board if M is greater than N; and a switch having an output to the game board computer whereby the game board computer operates under control of the game board program to replace the display of the N playable faces on the first display apparatus with the display of the additional set of up to N playable faces responsive to the switch output.

5. A method of enabling a player to play a bingo-like game that is a selected one of a first predetermined number, greater than one and denoted with the letter N, of bingo-like games in a session thereof, the method comprising the steps, carried out by an operator of the game, of:

providing the player with a game board comprising a game board computer having computer memory operatively associated therewith, the game board computer programmed to store in the computer memory data representative of at least N playable faces;

accepting payment from the player for at least one playable face associated with the selected game and subsequently manually inputting a sales datum into a sales computer, whereupon the sales computer communicates an enabling message associated with the selected game to the game board computer and whereupon a display apparatus portion of the game board displays the at least one playable face, the game board display apparatus not displaying the at least one playable face prior to receiving the enabling message.

6. The method of claim 5 wherein the selected one of the N games is not the first game in the session thereof and wherein a respective playable face associated with the first game is displayed on the game board when the game board is provided to the player.

7. The method of claim 5 wherein the game board displays at least two playable faces upon receiving the enabling message.

8. The method of claim 5 wherein the display apparatus portion of the game board is adapted to display up to a second predetermined number, denoted as M, playable faces, wherein the game board computer is programmed to store data representative of at least M times N playable faces, wherein the operator accepts payment for up to M playable faces and wherein after the enabling message is received, the display apparatus displays the up to M playable faces.

9. A method of enabling a player to play up to a first predetermined number that is greater than one and that is denoted with the letter N, of playable faces in a bingo-like game, the method comprising the steps, carried out by an operator of the game, of:

providing the player with a game board comprising a game board computer having computer memory operatively associated therewith, the game board computer programmed to store in the computer memory data representative of at least N playable faces;

accepting payment from the player for a player-selected number of playable faces, the player-selected number denoted with the letter M, wherein M is at least two but is no greater than N, and subsequently manually inputting a sales datum into a sales computer, whereupon the sales computer communicates an enabling message to the game board computer and a display apparatus portion of the game board displays the M playable faces, the game board not displaying more than one playable face prior to receiving the enabling message.

10. The method of claim 9 further comprising a plurality of the bingo-like games constituting a session thereof, wherein the operator accepts payment from the player for at least one player-selected game of the plurality thereof, and wherein the display apparatus portion of the game board computer displays a set of playable faces associated with the selected game.

11. The method of claim 9 wherein the display apparatus comprises a first portion that displays a predetermined number, less than M, of the playable faces after receiving the enabling message and a second portion that displays the remaining playable faces.

* * * * *